US006977668B2

(12) United States Patent
Sautter

(10) Patent No.: US 6,977,668 B2
(45) Date of Patent: Dec. 20, 2005

(54) PRINTING APPARATUS AND METHOD OF PRINTING AN INFORMATION CARRIER

(75) Inventor: Willi Sautter, Rosenfeld-Taebingen (DE)

(73) Assignee: Bizerba GmbH & Co. KG, Balingen (DE)

( * ) Notice: Subject to any disclaimer, the term of this patent is extended or adjusted under 35 U.S.C. 154(b) by 0 days.

(21) Appl. No.: 10/931,071

(22) Filed: Aug. 30, 2004

(65) Prior Publication Data

US 2005/0024472 A1 Feb. 3, 2005

Related U.S. Application Data

(63) Continuation of application No. PCT/EP03/03475, filed on Apr. 3, 2003.

(30) Foreign Application Priority Data

Apr. 23, 2002 (DE) ..... 102 18 842

(51) Int. Cl.[7] ..... B41J 25/304
(52) U.S. Cl. ..... 347/197; 400/120.16
(58) Field of Search ..... 347/197, 198, 347/215–217, 218; 400/120.17, 120.16

(56) References Cited

U.S. PATENT DOCUMENTS

| | | | |
|---|---|---|---|
| 4,172,671 | A | 10/1979 | Stenudd |
| 4,536,732 | A | 8/1985 | Schindl et al. |
| 4,879,566 | A | 11/1989 | Hanabusa |
| 5,478,159 | A | 12/1995 | Schneider et al. |
| 5,542,769 | A | 8/1996 | Schneider et al. |
| 5,757,389 | A | 5/1998 | Schwede et al. |
| 2001/0032554 | A1 | 10/2001 | Fritz et al. |

FOREIGN PATENT DOCUMENTS

| | | |
|---|---|---|
| DE | 33 19 466 C1 | 3/1984 |
| DE | 35 10260 C2 | 10/1986 |
| DE | 38 10464 A1 | 11/1988 |
| DE | 42 30 164 C2 | 3/1994 |
| DE | 43 32 562 A1 | 3/1995 |
| DE | 198 36 566 A1 | 2/2000 |
| GB | 2 204 834 A | 11/1988 |
| GB | 2 300 603 A | 11/1996 |
| JP | 01011869 | 1/1989 |
| JP | 09193399 | 7/1997 |

*Primary Examiner*—Huan Tran
(74) *Attorney, Agent, or Firm*—Leydig, Voit & Mayer, Ltd

(57) ABSTRACT

To improve a printing apparatus for printing an information carrier on a carrier tape, comprising a printing head, a first transport device by means of which the carrier tape is guidable past the printing head, and a second transport device by means of which a transfer tape is guidable past the printing head and which upon activation by the printing head causes an information carrier to be printed, with the contact pressure of the printing head on the transfer tape and on the carrier tape and the transfer tape feed by the second transport device being controllable in such a manner that the carrier tape is guidable past the printing head with a difference in speed relative to the transfer tape, such that this is of space-saving design and operates effectively, provision is made for the printing head to be pneumatically liftable away from the transfer tape.

37 Claims, 5 Drawing Sheets

88
70
54
68
72
60
20
76
84
78
80
62
64
36
74
82
42
66
40
24
16
86

PRINTING APPARATUS AND METHOD OF PRINTING AN INFORMATION CARRIER

This application is a continuation of international application No. PCT/EP03/03475 of Apr. 3, 2003, which claims priority to German application No. 102 18 842.4 of Apr. 23, 2002, both of which are incorporated herein by reference in their entirety and for all purposes.

BACKGROUND OF THE INVENTION

The invention relates to a printing apparatus for printing an information carrier on a carrier tape, comprising a printing head, a first transport device by means of which the carrier tape is guidable past the printing head, and a second transport device by means of which a transfer tape is guidable past the printing head and which upon activation by the printing head causes an information carrier to be printed, with the contact pressure of the printing head on the transfer tape and on the carrier tape and the transfer tape feed by the second transport device being controllable in such a manner that the carrier tape is guidable past the printing head with a difference in speed relative to the transfer tape.

Such printing apparatus are known, for example, from DE 35 10 260 C2 or DE 43 32 562 A1.

Once activated, a transfer tape area of a transfer tape which may, for example, be a thermal transfer tape, may no longer be used for printing. When the transfer tape is guided past the printing head synchronously with the carrier tape, even though no surfaces are to be printed, there is an unnecessary consumption of transfer tape as the transfer tape was not activated but nevertheless is wound up with the used transfer tape. Transfer tape consumption can be minimized by corresponding control of the transfer tape feed in such a manner that during a non-printing mode a difference in speed occurs relative to the carrier tape that is transported further, and, in particular, the transfer tape is stopped relative to the printing head.

SUMMARY OF THE INVENTION

In accordance with the present invention, a printing apparatus is improved such that it is of space-saving design and operates effectively.

This is accomplished in accordance with the invention in that the printing head is pneumatically liftable away from the transfer tape.

Such pneumatic control of the lifting-off of the printing head results in minimized masses having to be moved. Very short reaction times can thereby be achieved, and the system can be constructed in a space-saving manner. It can therefore be integrated well, for example, into a labelling machine. Owing to the minimizing of the mechanical coupling of the movable parts, wear and tear and thus susceptibility to failure are also minimized.

The printing apparatus according to the invention can be employed when the information carrier is an element which is separate from the carrier tape, for example, a self-adhesive label arranged on the carrier tape, or when the carrier tape itself forms the information carrier in so-called linerless technology.

In particular, provision is made for the printing head to be liftable away from the transfer tape and thus also from the carrier tape by means of a controllable air pulse or sequence of air pulses. Such a controllable air pulse or such a controllable sequence of air pulses can be produced in a simple way by means of a controllable through-valve which is connected to a pressure source. The signal strength (amplitude) of the air pulse can be set via the pressure source. The control, for example, of the through-valve can be carried out by means of a controlling device of the printing operation, which in the absence of larger areas that are not to be printed can then cause the printing head to be lifted off.

It is expedient for the air pulse or sequence of air pulses to be controllable with respect to time, so as to achieve minimized consumption of transfer tape during the printing of the information carriers on the carrier tape.

Short switching times, i.e., a high switching frequency, are achievable when the printing head is connected to a movable element which can be acted upon with pressure to lift the printing head away from the transfer tape. By means of corresponding application of pressure this element is then moved, and, in turn, this movement causes the printing head to be lifted off. Short reaction times are thereby achievable.

In principle, the movable element may be a compressed air cylinder. It is particularly advantageous for the element which can be acted upon with pressure to be a membrane. This can be constructed with minimized inertia so that the reaction times upon application of pressure are minimized. It has been found that a lifting-off of the printing head in the order of magnitude of 0.5 mm is adequate to sufficiently reduce the contact pressure. With a membrane with the advantages described above, such a relative movement can be achieved by application of pressure, and short reaction times are ensured.

The printing head is advantageously arranged so as to be pivotable, so that via the element which can be acted upon with pressure a torque can be applied to cause the printing head to be lifted away from the transfer tape.

A face which can be acted upon pneumatically and acts on the printing head holder to move the printing head is preferably arranged between the printing head and a pivot axis of the printing head holder so as to be able to bring about a lifting-off movement without disturbing the printing operation itself.

It is also expedient for the printing head to be arranged so as to be biased with respect to a guide surface for the carrier tape. A basic position of the printing head is thereby defined, namely the normal position suitable for the printing mode. By an active procedure, namely emission of an air pulse, the printing head is then pivoted away and automatically returns to its basic position when the application of pressure has been terminated. The actual function of the printing apparatus, namely the printing of the information carrier, is thereby ensured.

The biasing force counteracts a lifting force for lifting the printing head away from the guide surface, so as to ensure that the printing head returns to its basic position again when the application of pressure has been terminated.

To set the positions of the printing head in a defined manner, it is expedient to provide the printing head with a stop for movement away from the transfer tape and with a stop for movement towards it. This enables setting of a maximum possible spacing between the printing head and the transfer tape.

The stop is expediently arranged so as to lie opposite a face of a printing head holder, which can be acted upon pneumatically, in order to achieve a space-saving arrangement.

Furthermore, a stop is provided for movement of the printing head towards a guide surface for the carrier tape so that when the printing head returns after a lifting-off movement, the basic position for the printing mode can be reached in a defined manner.

It is expedient for the stop to lie in the proximity of the guide surface or to form at least part of the guide surface so as to re-establish the basic position in a defined manner.

It is particularly expedient for a stop to be provided with a damping element, for example, a piece of felt so as to avoid a hard striking and thereby increase the service life of the printing apparatus.

Provision is advantageously made for a guide surface for the carrier tape during printing to be formed on a stripping element for the carrier tape.

At such a stripping element, the carrier tape is deflected after printing of the information carriers, so as to guide the printed information carrier out of the printing apparatus and enable a user to remove the information carrier.

It is particularly advantageous for the movement of the printing head to be switchable at a switching frequency of 80 Hz or faster. Such switching frequencies are achievable with pneumatic activation of the printing head, in particular, via a printing head holder and a pressure cylinder which, in particular, is a membrane.

To achieve a defined unwinding of an unused transfer tape and a defined winding-up of a used transfer tape, the second transport device advantageously comprises a transfer tape take-off reel and a transfer tape take-up reel.

It is particularly advantageous for the transportation of the transfer tape by the second transport device to be pneumatically stoppable. Further transportation of the transfer tape in the printing apparatus can then be stopped simultaneously with the lifting-off movement of the printing head with respect to the transfer tape. In this way, synchronization of the second transport device with respect to transportation of the transfer tape with the movement of the printing head is then achievable.

It is particularly advantageous when an air pulse or sequence of air pulses for moving the printing head away from the transfer tape simultaneously brings about a braking of the movement of the transfer tape. The air pulse or sequence of air pulses generated via a through-valve can then simultaneously serve to lift off the printing head and stop transportation of the transfer tape.

In turn, an automatic synchronization of these two procedures is thereby achievable. In particular, provision is made for the air pulse or sequence of air pulses to actuate a brake of a transfer tape take-off reel and/or transfer tape take-up reel so as to block further transportation of the transfer tape past the printing head.

To achieve unwinding of the unused transfer tape and winding-up of the used transfer tape, the transfer tape take-up reel alone is directly driven or the transfer tape take-up reel and the transfer tape take-off reel are directly driven. It is preferable for the transfer tape take-up reel to be directly driven, while the other reel is then indirectly driven via the transfer tape.

The object mentioned at the outset is accomplished in accordance with the invention alone or in combination with the features explained hereinabove in that a drive for the second transport device for moving the transfer tape is designed as a slip drive. With such a slip drive, axial bearing forces acting on rotating parts can be minimized. Since a flexible design is possible, there is no necessity for high mechanical precision with respect to the bearing and drive, and so the corresponding drive can be realized at reasonable cost. Furthermore, a self-adjusting abutment of the relevant friction surfaces can be achieved, which results in a high frictional moment stability.

In particular, a transfer tape take-up reel and/or a transfer tape take-off reel and, in particular, the directly driven reel is driven at overspeed. Via a corresponding slip, which, in particular, is settable, the desired rotational speed for the reel then adjusts itself.

Such a slip drive can be advantageously realized when it comprises an, in particular, directly driven element which is coupled to a transfer tape receptacle by a frictional connection. The transfer tape receptacle is thus rotatable via the coupling by means of the driven element. Owing to the frictional coupling, however, a certain slip can be achieved, via which, for example, a frictional moment stability is, in turn, achievable.

Such a frictional coupling is achievable in a simple way when the driven element and the transfer tape receptacle are magnetically coupled. For this purpose, the transfer tape receptacle has, for example, a plurality of receptacles for magnets facing the driven element. The magnets may be electromagnets or permanent magnets.

The slip moment or torque can then be set by fitting or wiring magnets in the magnet receptacles. An adaptation, for example, to the material of the transfer tape and/or the carrier tape can thus also be carried out by the subsequent fitting or removal of magnets. With, for example, N receptacles, which can be fitted with M magnets, an N×M graduation with respect to the setting of the slip moment can be achieved.

Preferably, either the transfer tape take-up reel or the transfer tape take-off reel is directly driven. It is then expedient for the reel that is not (directly) driven to comprise a slip clutch by means of which a transfer tape receptacle is non-rotatably fixable with respect to a housing of the printing apparatus. The slip clutch can be designed such that the transfer tape receptacle rotates when the other reel is driven. The torque for rotation of the transfer tape receptacle is transmitted by the transfer tape. However, if the drive is then stopped, the slip clutch also causes the transfer tape receptacle to be stopped via the non-rotatable fixing with respect to the housing. In turn, the transfer tape is thereby always kept taut also when transportation is stopped, so that sagging, folding, bending or the like is avoided.

In particular, the fixing is carried out by frictional connection and preferably by means of magnetic forces. For this purpose, similarly to the above description in conjunction with the slip drive, the transfer tape receptacle is provided with a plurality of magnet receptacles in which magnets are insertable.

Again the fixing force is settable by fitting or wiring magnets in the magnet receptacles. The torque required to rotate the transfer tape receptacle can be set via the fixing force alone.

It is expedient for a shaft stub arranged non-rotatably, in particular, with respect to a housing of the printing apparatus to be provided for the transfer tape take-up reel and/or the transfer tape take-off reel, and for a sleeve for receiving the transfer tape to be rotatably seated on the non-rotatably arranged shaft stub. Rigid shafts with respect to which tensile forces are minimized are thereby achievable.

The invention also relates to a method for printing information carriers on a carrier tape by means of a printing head which activates a transfer tape.

Herein the underlying object is to provide a method with minimized reaction times.

This object is accomplished in accordance with the invention in that the printing head is pneumatically liftable away from the transfer tape.

The method according to the invention has the advantages described hereinabove in conjunction with the printing apparatus according to the invention. Further advantageous embodiments of this method have also been explained in conjunction with the apparatus according to the invention.

In particular, it is advantageous for an air pulse or a sequence of air pulses which lifts the printing head away from the transfer tape to stop transportation of the transfer tape.

The following description of preferred embodiments serves in conjunction with the drawings to explain the invention in greater detail.

DETAILED DESCRIPTION OF THE INVENTION

Figure 1:
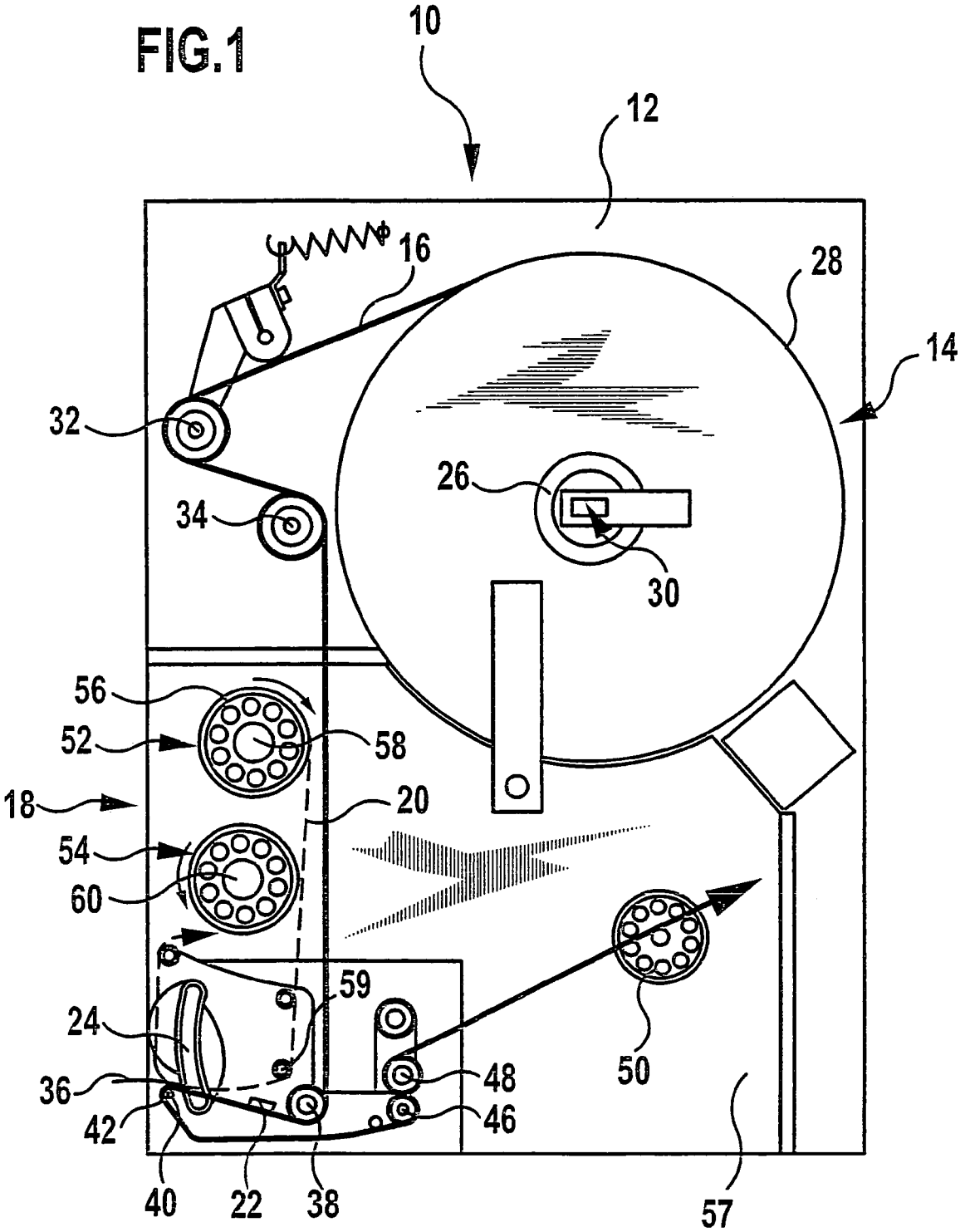
FIG. 1 shows a plan view of an embodiment of an inventive printing apparatus.

An embodiment of a printing apparatus according to the invention, which is generally designated 10 in FIG. 1, comprises a stable housing base 12 which is designed so as to absorb the prevailing forces. This housing base 12 holds a housing (not shown in the drawings).

The printing apparatus comprises a first transport device, generally designated 14, for transporting through the apparatus a carrier tape 16 with information carriers on which printing is to be performed.

A second transport device, generally designated 18, by means of which a transfer tape 20 is transportable through the apparatus is also provided.

Carrier tape 16 and transfer tape 20 are guided by the transport devices 14 and 18, respectively, so as to converge in a printing area 22, so that printing can be performed on information carriers, for example, labels, on the carrier tape 16 by means of activation of the transfer tape 20 by a printing head 24.

In particular, the transfer tape 20 is an inked ribbon or a thermal transfer ribbon. In this case, the printing head 24 is designed as a thermal printing head comprising individually activatable needle-shaped heating elements which effect transfer of ink from the transfer tape 20 onto the information carrier on the carrier tape 16.

The first transport device 14 for the carrier tape 16 comprises a holder 26 for a roll 28 of carrier tape, from which carrier tape 16 can be unwound for delivery to the printing head 24. In particular, the holder 26 is not driven, and an axis of rotation 30 for the roll 28 of carrier tape extends transversely and, in particular, perpendicularly to the housing base 12 (perpendicularly to the drawing plane of FIG. 1). The carrier tape is unwound tangentially from the roll 28 of carrier tape and is aligned by means of deflection rollers 32, 34 in such a manner that it can be delivered to the printing head 24. In particular, the printing head 24 is arranged in a corner area of the housing base 12 so that an information carrier 36, for example, a label, is easily removable after the printing, and sufficient space is available for accommodating the roll 28 of carrier tape. The deflection rollers 32, 34 are, for example, arranged in such a manner that after passing over these deflection rollers 32, 34, the carrier tape is guided substantially parallel to a side of the housing base.

The carrier tape 16 is deflected over a further deflection roller 38 in such a manner that it is guidable past the printing head 24 for the printing to be performed on the information carriers 36. A guide surface 42 for guiding the carrier tape 16 during the printing is formed on a stripping element 40. The stripping element 40 is designed such that the direction of the carrier tape is changed after the printing, and the printed information carrier is removable at a housing slot.

The carrier tape is guided over further deflection elements 46, 48 to a carrier tape spooler 50 which takes up the carrier tape after release of the printed information carriers 36.

This carrier tape spooler 50 is arranged in an area 57 of the housing base 12, which lies between the holder 26 for the roll 28 of carrier tape and the printing area 22 so as to provide a suitable space for winding up the carrier tape 16.

In principle, it is possible for releasable information carriers 36 that are printed to be arranged on the carrier tape 16 or for the carrier tape to be directly printable in the so-called linerless process (in which case the carrier tape is not a carrier for information carriers but is the information carrier itself). In the linerless case, the printing apparatus must be designed as described in EP 0 758 979 B1, to which reference is hereby explicitly made. In particular, means arranged downstream of the printing head 24 and adjacent a print roller are then provided for stripping a portion of the (adhesive-coated) carrier tape 16 off the print roller, to enable the carrier tape 16 with the information imprinted on the side thereof located opposite the layer of adhesive to be withdrawn from the printing apparatus 10.

The second transport device 18 for transporting the transfer tape 20 comprises a rotatable transfer tape take-off reel 52 and a rotatable and, in particular, directly driven transfer tape take-up reel 54. The transfer tape 20 is unwound as roll 56 of transfer tape from the transfer tape take-off reel 52 and thereby guided approximately parallel to the carrier tape 16 to the printing head 24. A deflection occurs at a deflection element 59 in order to bring the transfer tape 20 and the carrier tape 16 into contact with one another. The transfer tape 20 is then guided past the printing head 24, and used transfer tape 20 is wound up by the transfer tape take-up reel 54.

The axes of rotation 58 and 60 of the transfer tape take-off reel 52 and the transfer tape take-up reel 54, respectively, lie parallel to one another substantially perpendicularly to the housing base 12 and therefore also parallel to the axis of rotation 30 of the holder 26 for the roll 28 of carrier tape. The transfer tape take-up reel 54 and the transfer tape take-off reel 52 rotate in opposite directions of rotation.

The transfer tape 20 and the carrier tape 16 are guided in synchronization with one another for the printing, so essentially no relative speed exists between the carrier tape 16 and the transfer tape 20 during activation of the printing head 24. In order to print an information carrier 36, the transfer tape is acted upon in a partial area thereof by the printing head 24.

After the printing, this partial area which has been acted upon is taken away, i.e., delivered to the transfer tape take-up reel 54 as this area is no longer usable for printing.

In principle, it is only necessary to guide the transfer tape 20 and the carrier tape 16 synchronously during the printing. In order to avoid excessive consumption of transfer tape 20, provision is made in accordance with the invention for transportation of transfer tape by the second transport device 18 to be braked, and, in particular, stopped when printing is not to be performed while the carrier tape 16 moves past the printing head 24. This is the case, in particular, when an information carrier 36 has larger areas that are not to be printed.

Figure 2:
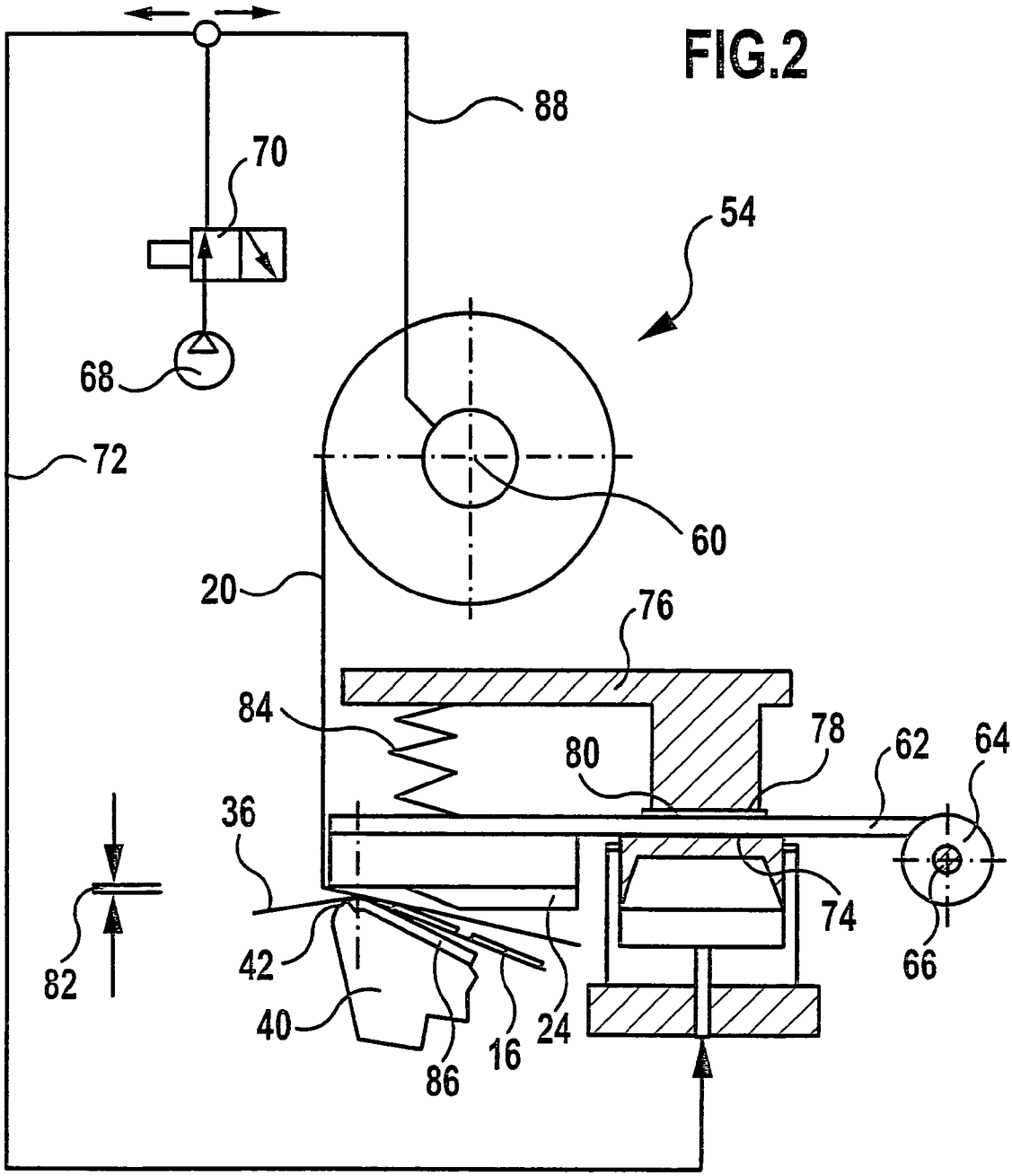
FIG. 2 shows a schematic illustration of elements of the printing apparatus according to FIG. 1 to elucidate the way in which it operates.

In order that transport of the transfer tape 20 can be stopped upon further transportation of the carrier tape 16, a difference in the speed of carrier tape 16 and transfer tape 20 must be able to come about. For this purpose, it is necessary for the contact pressure of the printing head 24 on the transfer tape 20 in the direction of the carrier tape 16 to be reduced. In accordance with the invention, provision is made, as shown in FIG. 2, for the printing head 24 to be pivotably arranged by means of a pivot bearing 64 on the housing base 12 via a printing head holder 62. A pivot axis 66 is arranged parallel to the axes of rotation 58, 60. The printing head holder 62 with the printing head 24 firmly seated thereon can be pivoted away from the transfer tape 20 pneumatically, i.e., by compressed air acting thereon. A device 68 for applying an excess pressure having a controllable through-valve 70 coupled thereto is provided for this purpose. A pressure line 72 leads from this through-valve to an element 74, in particular, a membrane, which can be acted upon with pressure. This element 74 which can be acted upon with pressure is movable in such a manner that a pivoting movement of the printing head 24 away from the carrier tape 16 can be initiated by it when correspondingly acted upon with pressure. For this purpose, the element 74 which can be acted upon with pressure is coupled to the printing head holder 62 via a face which can be acted upon pneumatically in order to bring about a pivoting movement of the printing head holder 62 via the movement of the element 74 which can be acted upon with pressure.

Seated rigidly on the housing base 12 is a holding element 76 which provides a stop surface 78 for movement of the printing head holder 62 in order to delimit pivotability of the printing head 24 away from the carrier tape 16. In particular, this stop surface 78 is arranged so as to be located opposite the face of the printing head holder 62 which can be acted upon pneumatically, via which the element 74 which can be acted upon with pressure acts on the printing head holder 62.

The stop surface 78 is provided with a damping element 80, for example, a piece of felt, to avoid a hard strike.

A distance in height 82, to which the printing head 24 can be lifted at most off the carrier tape 16 lies, for example, in the order of magnitude of approximately 0.5 mm or less.

Seated on the holding element 76 is a spring 84 which biases the printing head holder 62 in such a manner that the printing head 24 presses the transfer tape 20 against the carrier tape 16 with the contact force necessary for the printing. When the printing head holder 62 pivots away from the carrier tape 16, the spring force of the spring 84 must be overcome. If the application of pressure is taken away, the spring 84 acts as return spring with a returning force which moves the printing head holder 62 with the printing head 24 in the direction of the carrier tape 16 and presses the transfer tape 20 against the carrier tape 16.

The face of the printing head holder 62 which is acted upon pneumatically is arranged between a face of the spring 84 which acts upon the printing head holder 62 and the pivot axis 66 of the printing head holder 62. The spring 84 is also arranged in such a manner that the contact force of the printing head 24 which is then exerted by the transfer tape 20 on the carrier tape 16 acts on the area of the guide surface 42 for the carrier tape on the stripping element 40.

In particular, provision is made for the stripping element 40 to be formed as stop for the printing head 24 with a damping element 86 which lies against the guide surface 42 or even forms part of this guide surface 42. A hard striking of the printing head 24 on the stripping element 40 upon return of the printing head holder 62 is avoided by this damping element 86.

A pressure line 88 also leads from the device 68 for applying excess pressure to the transfer tape take-up reel 54. By applying pressure to the pressure line 88, the transfer tape take-up reel 54 can be braked and, in particular, stopped, so that further transportation of the transfer tape 20 is stopped.

The through-valve 70 can be controlled, i.e., in particular, opened and closed, by means of a control device for the printing operation (not shown in the drawings). The control is carried out with respect to time, i.e., when a larger area that is not to be printed occurs, the through-valve 70 is opened in order to apply pressure to the pressure lines 72 and 88. An air pulse or a sequence of air pulses is thereby transferred by these pressure lines 72 and 88, which introduces the corresponding controlling procedures for the printing head 24 and the transfer tape take-up reel 54. In dependence upon the set volumetric flow rate and the set pressure, very quick switching operations can be realized with a switching frequency in the order of magnitude of 80 Hz or faster. To set the volumetric flow rate and the pressure, provision may also be made for a throttle to be included (not shown in the drawings).

If the through-valve 70 is open, the corresponding air pulse or pressure pulse then acts on the membrane 74, which, in turn, acts on the face of the printing head holder 62 that can be acted upon pneumatically and pivots the printing head holder 62 away from the carrier tape 16, so that the contact pressure of the transfer tape 20 on the carrier tape 16 is reduced.

This air pulse or pressure pulse also acts on the pressure line 88 and brakes and, in particular, stops the transfer tape take-up reel 54 so that further transportation of the transfer tape 20 is stopped.

With the pneumatic control of the pivoting movement of the printing head 24 and the braking of the driven transfer tape take-up reel 54, a transfer tape economy circuit is realized, which with minimum mechanical coupling and minimized moved mass reacts quickly. The corresponding economy circuit can be used effectively and set up in a space-saving manner and is therefore easily integrated into a housing.

Figure 3:
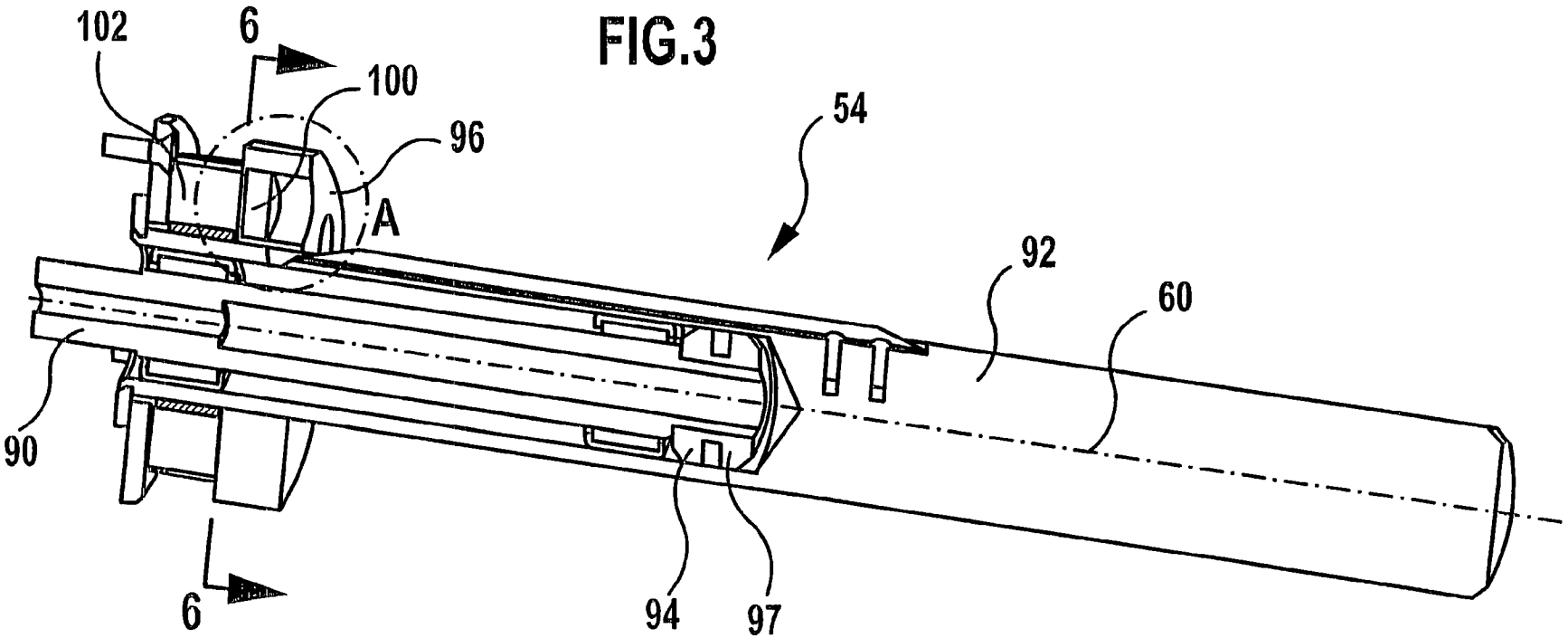
FIG. 3 shows a perspective partially sectional view of a transfer tape take-up reel.

The transfer tape take-up reel 54 comprises, as shown in FIG. 3, a shaft stub 90 which is rigidly non-rotatably arranged with respect to the housing base 12. Rotatably seated on the shaft stub 90 is a sleeve 92, i.e., the sleeve 92 is rotatably mounted on the shaft stub 90. This sleeve 92, in turn, forms a receptacle for the (used up) transfer tape 20.

Arranged on the shaft stub 90 is a brake 94 which is, for example, a piston brake which is connected to the pressure line 88 and is pressure-actuatable. The brake 94 comprises, for example, a piston 97 which, when acted upon with an air pulse or a sequence of air pulses, braces the sleeve 92 with the shaft stub 90 so that rotatability of the sleeve 92 in relation to the shaft stub 90 is blocked.

Figure 5:
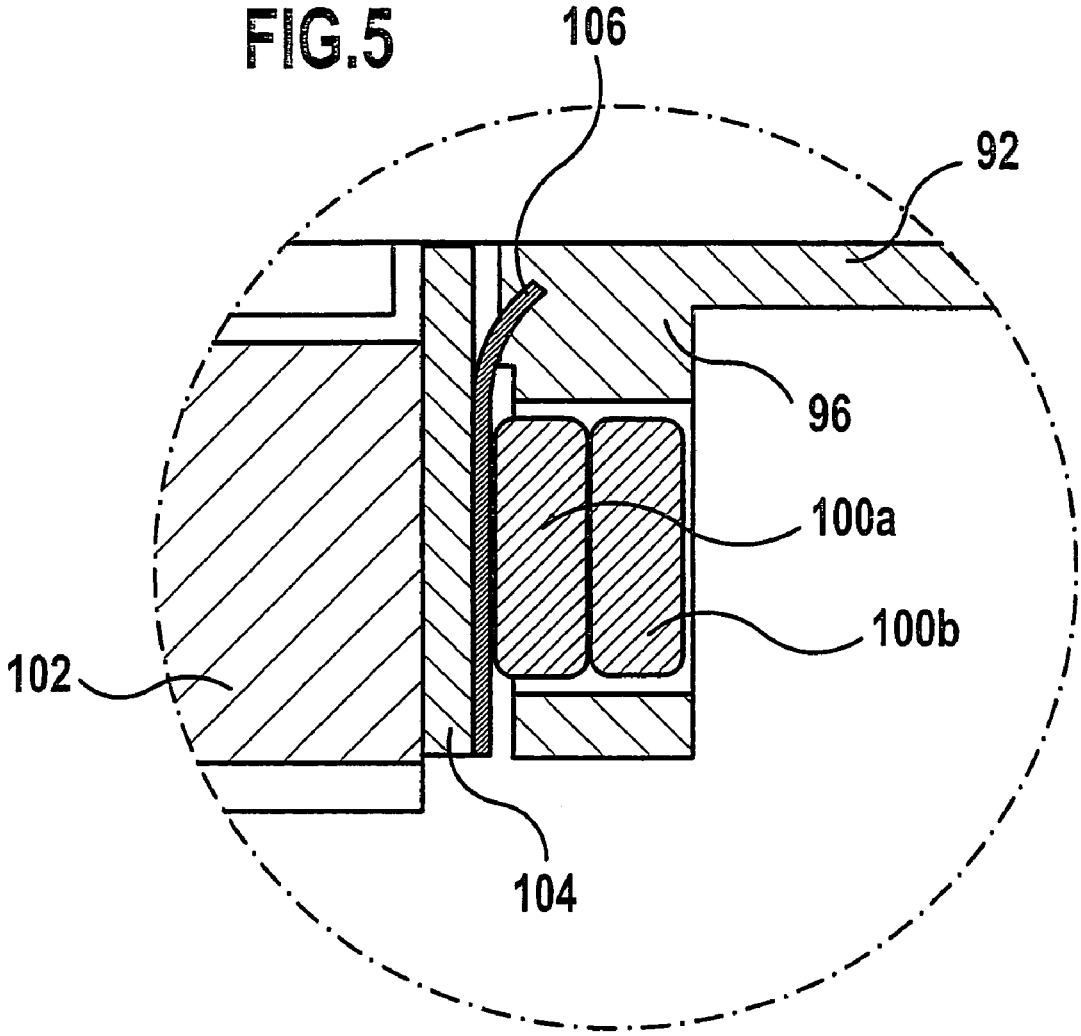
FIG. 5 shows an enlarged view of area A according to FIG. 3.

Seated on the sleeve 92 facing the housing base 12 is a disc-shaped flange 96 which comprises a plurality of receptacles 98 for magnets 100 (FIGS. 3, 5, 6) facing the housing base 12. These receptacles are preferably arranged in such a manner that they are distributed around the axis of rotation 60. Each individual receptacle 98 can be fitted with one or more magnets 100*a*, 100*b* (cf. FIG. 5).

Seated between the flange 96 and the housing base 12 is a disc 102 which is arranged so as to be rotatable about the shaft stub 90. In particular, this disc 102 is directly driven. If the flange 96 is firmly coupled to the disc 102, the sleeve 92 is rotated concurrently in accordance with the rotational speed of the disc 102.

A slip drive for the sleeve 92 is formed by the disc 102 and the flange 96 which can be fitted with magnets 100. For this purpose, the disc 102 is made of a material which is magnetically conductive and, in particular, contains iron, so that the flange 96 can be magnetically coupled to the disc 102.

Provision may also be made for a flexible element 104, for example, a felt disc, to be arranged between the disc 102 and the flange. A further flexible element 106, for example, a thin band of steel, can also be arranged on the flange 96. This is of such flexibility that it can adapt to the disc 102 and the flexible element 104 seated thereon so as to achieve an optimum transfer of force from the flange 96 to the disc 102.

The magnets 100 may be permanent magnets or electromagnets. In the case of electromagnets, these are, in particular, individually switchable, so as to realize an externally switched coupling whose slip is externally controllable.

Figure 6:
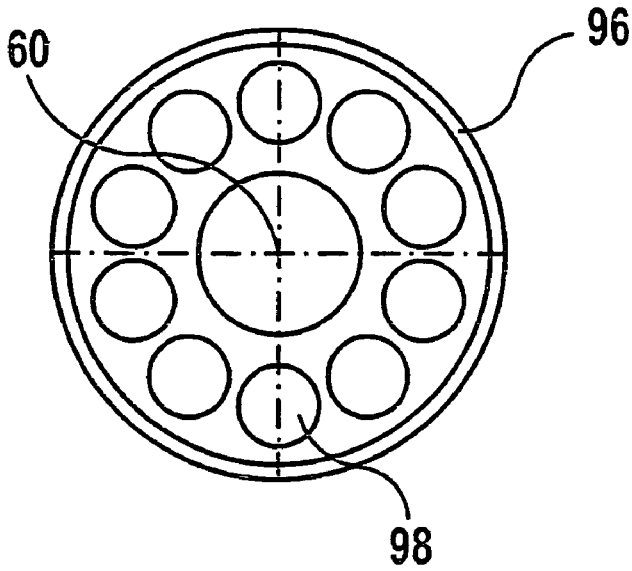
FIG. 6 shows a sectional view of the transfer tape take-up reel according to FIG. 3 taken on line 6—6.

The force exerted on the disc 102 and thus the slip moment can be set by correspondingly fitting the receptacles 98 of the flange 96 with permanent magnets 100. If, for example, two magnets 100*a*, 100*b* are positionable in a receptacle 98 (FIG. 5), and if, as shown in FIG. 6, the flange has nine receptacles, with use of identical magnets 100, the forces can then be set in 18 steps and thus the slip moments in 18 steps. With a corresponding selection of magnets, the slip moment or the torque which the sleeve 92 experiences can thus be adapted to the processing parameters if, for example, the material of the carrier tape 16 and/or the material of the transfer tape 20 changes.

The disc 102 is driven at a rotational speed which is higher that the rotational speed desired for the sleeve 92, i.e., is greater than the desired winding-on speed of the transfer tape 20 on the transfer tape take-up reel 54. The coupling between the sleeve 92 and the driven disc 102 is affected via the magnetic forces of the magnet or magnets 100 acting on the disc 102. With corresponding setting of this force, a relative movement results between the sleeve 92 with its flange 96 and the disc 102 so as to obtain the desired rotational speed of the sleeve 92. In this case, there is slip or low-friction sliding of the flange 96 with respect to the disc 102.

The slip drive consequently comprises a slip clutch (friction clutch).

In this way, axial bearing forces of the sleeve 92 on the shaft stub 90 can be minimized, so that the force load on the housing base 12 is minimized even with larger rolls of transfer tape. By way of self-adjusting abutment of the corresponding friction surfaces during rotation of the sleeve 92 with respect to the disc 102, the driven rotation of the sleeve 92 is also stable with respect to frictional moment, and owing to the flexible adaptability, high mechanical precision is not necessary.

Figure 4:
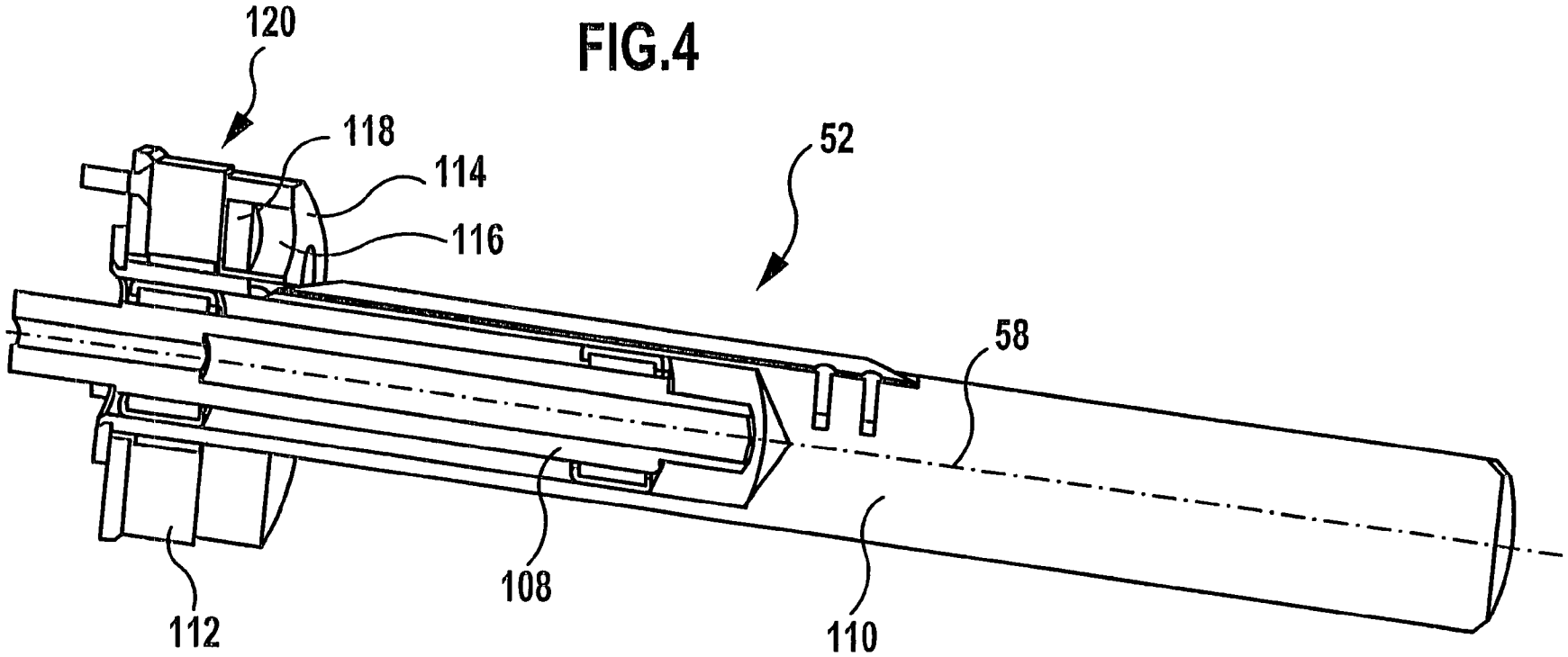
FIG. 4 shows a perspective partially sectional view of a transfer tape take-off reel.

The transfer tape take-off reel 52, which is not driven directly, is also provided with a slip clutch, as shown in FIG. 4. The transfer tape take-off reel 52 also comprises a shaft stub 108 which is non-rotatably connected to the housing base 12. Rotatable about the shaft stub 108 is a sleeve 110 which serves as receptacle for a roll of (unused) transfer tape 20. Rotation of the sleeve 110 with respect to the shaft stub 108 is driven indirectly by the transfer tape take-up reel 54 through the intermediary of the transfer tape 20.

A disc 112 is non-rotatably seated around and connected to the shaft stub 108. Seated on the sleeve 110 is a disc-shaped flange 114 which faces the disc 112 and, similarly to the above description in conjunction with flange 96, comprises a plurality of receptacles 116 for magnets 118. The disc 112 is made of a material which is magnetically conductive, for example, steel with a corresponding iron component, so that the disc 112 and the sleeve 110 can be coupled via the flange 114 with one or more magnets 118. Again the coupling strength can be set by correspondingly fitting the receptacles 116 with magnets. In principle, the receptacles are arranged as described in conjunction with FIG. 6 for the flange 96. The setting of the coupling strength is also carried out in the same way.

The sleeve 110 can be fixed with respect to the housing base 12 via the flange 114 with the frictional coupling to the disc 112.

When the transfer tape take-up reel 54 is stopped owing to a corresponding air pulse or a corresponding sequence of air pulses, there is, in principle, the danger that the transfer tape will sag or be bent or the like. Owing to the provision of a slip clutch 120 for the transfer tape take-off reel 52 which is not driven directly, these disturbing effects are avoidable since without any (indirect) driving of the sleeve 110 via the transfer tape take-up reel 54, its rotation is braked immediately owing to the slip clutch 120 and the transfer tape is thus held in a taut manner with the printing head 24 lifted off.

In this configuration of the transfer tape take-off reel 52, too, the axial shaft forces are minimized.

The printing apparatus 10 according to the invention operates as follows:

When printing an information carrier 36 on the carrier tape 16, the spring 84 presses the printing head 24 in the direction of the stripping element 40 via the printing head holder 62 so that the printing head 24 exerts a contact pressure on the transfer tape 20 and on the carrier tape 16. In this operating mode, the carrier tape 16 and the transfer tape 20 are guided past the printing head 24 synchronously with essential zero speed difference.

When a larger area that is not to be printed occurs, the control device sends the through-valve 70 a corresponding control signal and this opens briefly, with typical switching frequencies being about 80 Hz or more. An air pulse or a sequence of air pulses is thereby emitted to the pressure lines 72 and 88. This, in turn, causes the directly driven transfer tape take-up reel 54 to be stopped via the brake 94 and simultaneously the printing head 24 to be lifted off the transfer tape 20 via the element 74 which can be acted upon with pressure. As a result of this, a relative speed can come about between the carrier tape 16 and the transfer tape 20 while passing the printing head 24, with, in particular, no transportation of the transfer tape 20 with respect to the printing head 24 taking place.

As the transfer tape is not transported further owing to the stopping of rotation of the transfer tape take-up reel 54, the rotation of the sleeve 110 of the transfer tape take-off reel 52 is thereby also stopped. Via the slip clutch 120 the transfer tape 20 is kept taut, since without any torque being applied to the sleeve 110 (during transportation of the transfer tape 20 through the intermediary of the transfer tape 20 itself) the sleeve 110 couples non-rotatably with the disc 112 via the flange 114.

After termination of the air pulse or the sequence of air pulses, the spring 84 causes the printing head 24 to be returned in the direction of the carrier tape 16 so as to enable further printing of information carriers 36. During the return, the brake 94 is also released so that the sleeve 92 can transport further and thus the transfer tape 20 is again transportable essentially synchronously with the carrier tape 16 through the printing apparatus 10.

With the slip drive for the transfer tape take-up reel 54 a drive for winding up the (used) transfer tape, which is stable with respect to frictional moment, is achieved.

What is claimed is:

1. A printing apparatus for printing an information carrier on a carrier tape utilizing a transfer tape, the printing apparatus comprising:

a printing head having a contact pressure on the transfer tape in the direction of the carrier tape, and being adapted to be pneumatically lifted away from the transfer tape;

a moveable element, the printing head being connected to said movable element, the movable element being adapted to be acted upon with pressure to lift the printing head away from the transfer tape;

a first transport device, the first transport device being adapted to guide the carrier tape past the printing head; and a second transport device, the second transport device acting as a transfer tape feed guiding the transfer tape past the printing head, the transfer tape being disposed to be activated by the printing head to cause said information carrier to be printed on the carrier tape;

wherein the contact pressure of the printing head on the transfer tape in the direction of the carrier tape, and the transfer tape feed by the second transport device are controllable in such a manner that the carrier tape is guidable past the printing head with a difference in speed relative to the transfer tape.

2. The printing apparatus in accordance with claim 1, wherein the printing head is adapted to be lifted away from the transfer tape by means of at least one of a controllable air pulse or sequence of air pulses.

3. The printing apparatus in accordance with claim 2, wherein the air pulse or sequence of air pulses is controllable with respect to time.

4. The printing apparatus in accordance with claim 1, wherein the element which is adapted to be acted upon with pressure is a membrane.

5. The printing apparatus in accordance with claim 1, wherein the printing head is arranged so as to be pivotable.

6. The printing apparatus in accordance with claim 5, further comprising a printing head holder secured with the printing head, the printing head holder comprising a pivot axis, and printing head holder further comprising a face disposed between the printing head and the pivot axis, the face being adapted to be acted upon pneumatically to move the printing head.

7. The printing apparatus in accordance with claim 1, further comprising a guide surface for the carrier tape, the printing head being arranged so as to be biased with respect to said guide surface for the carrier tape.

8. The printing apparatus in accordance with claim 7, wherein a biasing force for biasing said printing head with respect to said guide surface counteracts a force for lifting the printing head away from the guide surface.

9. The printing apparatus in accordance with claim 1, further comprising a stop, the stop being disposed to limit movement of the printing head away from the transfer tape.

10. The printing apparatus in accordance with claim 9, further comprising a printing head holder having a face adapted to acted upon pneumatically, the stop being arranged so as to lie opposite the face of the printing head holder.

11. The printing apparatus in accordance with claim 10, wherein the stop is provided with a damping element.

12. The printing apparatus in accordance with claim 1, further comprising a guide surface of the carrier tape and a stop, the stop being disposed to limit movement of the printing head towards the guide surface of the carrier tape.

13. The printing apparatus in accordance with claim 12, wherein the stop lies in a proximity of the guide surface or forms at least part of the guide surface.

14. The printing apparatus in accordance with claim 1, further comprising a stripping element for the carrier tape and a guide surface for the carrier tape during printing, said guide surface being formed on the stripping element for the carrier tape.

15. The printing apparatus in accordance with claim 1, wherein movement of the printing head is switchable at a switching frequency of 80 Hz or faster.

16. The printing apparatus in accordance with claim 1, wherein the second transport device comprises a transfer tape take-off reel and a transfer tape take-up reel.

17. The printing apparatus in accordance with claim 16, wherein the transfer tape take-off reel is indirectly driven.

18. The printing apparatus in accordance with claim 16, wherein the transfer tape take-up reel is directly driven or the transfer tape take-up reel and the transfer tape take-off reel are directly driven.

19. The printing apparatus in accordance with claim 16, further comprising a transfer tape receptacle and a housing, wherein the transfer tape take-up reel is directly driven, and the transfer tape take-off reel is not directly driven and comprises a slip clutch by means of which said transfer tape receptacle is non-rotatably fixable with respect to said housing.

20. The printing apparatus in accordance with claim 19, wherein the transfer tape receptacle is non-rotatably fixable with respect to said housing in a frictionally connected manner.

21. The printing apparatus in accordance with claim 19, wherein the transfer tape receptacle is non-rotatably fixable with respect to said housing by means of magnetic forces.

22. The printing apparatus in accordance with claim 19, wherein the transfer tape receptacle is provided with a plurality of magnet receptacles.

23. The printing apparatus in accordance with claim 22, wherein the transfer tape receptacle is non-rotatably fixable with respect to said housing by fitting or wiring magnets in the magnet receptacles to set a fixing force.

24. The printing apparatus in accordance with claim 16, wherein at least one of the transfer tape take-up reel and the transfer tape take-off reel comprise a non-rotatably arranged shaft stub, and a sleeve for receiving the transfer tape, said sleeve being rotatably seated on the non-rotatably arranged shaft stub.

25. The printing apparatus in accordance with claim 1, wherein transportation of the transfer tape by the second transport device is pneumatically stoppable.

26. The printing apparatus in accordance with claim 1, wherein the second transport device is synchronizable with movement of the printing head.

27. The printing apparatus in accordance with claim 1, wherein an air pulse or a sequence of air pulses for lifting the printing head away from the transfer tape simultaneously brings about a braking of the movement of the transfer tape.

28. The printing apparatus in accordance with claim 27, wherein the second transport device comprises at least one of a transfer tape take-off reel and a transfer tape take-up reel, and a brake disposed to brake at least one of said transfer tape take-off reel and said transfer tape take-up reel, and wherein the air pulse or sequence of air pulses actuates said brake.

29. The printing apparatus in accordance with claim 1, further comprising a drive for the second transport device for moving the transfer tape, said drive being a slip drive.

30. The printing apparatus in accordance with claim 29, wherein said second transport device comprises at least one of a transfer tape take-up reel and a transfer tape take-off reel driven at overspeed.

31. The printing apparatus in accordance with claim 29, further comprising a transfer tape receptacle, and wherein the slip drive comprises a directly driven element which is coupled to said transfer tape receptacle by a frictional connection.

32. The printing apparatus in accordance with claim 31, wherein the driven element and the transfer tape receptacle are magnetically coupled.

33. The printing apparatus in accordance with claim 32, wherein the transfer tape receptacle comprises a plurality of receptacles for magnets facing the driven element.

34. The printing apparatus in accordance with claim 33, wherein a slip moment is settable by at least one of fitting or wiring magnets in the magnet receptacles.

35. A method for printing information carriers on a carrier tape by means of a printing head which activates a transfer tape, said method comprising:

the step of transporting transfer tape; and the step of selectively pneumatically lifting the printing head away from the transfer tape by activating an air pulse or a series of air pulses to stop transportation of the transfer tape.

36. A printing apparatus for printing an information carrier on a carrier tape utilizing a transfer tape, the printing apparatus comprising:

a printing head having a contact pressure on the transfer tape in the direction of the carrier tape, and being adapted to be pneumatically lifted away from the transfer tape, the printing head arranged so as to be pivotable;

a printing head holder secured with the printing head, the printing head holder comprising a pivot axis, and printing head holder further comprising a face disposed between the printing head and the pivot axis, the face being adapted to be acted upon pneumatically to move the printing head;

a first transport device, the first transport device being adapted to guide the carrier tape past the printing head; and a second transport device, the second transport device acting as a transfer tape feed guiding the transfer tape past the printing head, the transfer tape being disposed to be activated by the printing head to cause said information carrier to be printed on the carrier tape;

wherein the contact pressure of the printing head on the transfer tape in the direction of the carrier tape, and the transfer tape feed by the second transport device are controllable in such a manner that the carrier tape is guidable past the printing head with a difference in speed relative to the transfer tape.

37. A printing apparatus for printing an information carrier on a carrier tape utilizing a transfer tape, the printing apparatus comprising:

a printing head having a contact pressure on the transfer tape in the direction of the carrier tape, and being adapted to be pneumatically lifted away from the transfer tape, the printing head arranged so as to be pivotable;

a first transport device, the first transport device being adapted to guide the carrier tape past the printing head;

a guide surface for the carrier tape, the printing head being arranged so as to be biased with respect to said guide surface for the carrier tape; and a second transport device, the second transport device acting as a transfer tape feed guiding the transfer tape past the printing head, the transfer tape being disposed to be activated by the printing head to cause said information carrier to be printed on the carrier tape;

wherein the contact pressure of the printing head on the transfer tape in the direction of the carrier tape, and the transfer tape feed by the second transport device are controllable in such a manner that the carrier tape is guidable past the printing head with a difference in speed relative to the transfer tape.

* * * * *